US005211755A

United States Patent [19]

Hangley, II

[11] Patent Number: 5,211,755

[45] Date of Patent: May 18, 1993

[54] APPARATUS FOR APPLYING A CREASING AGENT TO A FORMED CREASE IN A TEXTILE ARTICLE

[76] Inventor: James P. Hangley, II, 331 W. Pine St., Long Beach, N.Y. 11561

[21] Appl. No.: 746,715

[22] Filed: Aug. 19, 1991

[51] Int. Cl.[5] ..... B05C 5/00; B05C 13/02

[52] U.S. Cl. ..... 118/306; 223/29

[58] Field of Search ..... 223/28, 29; 427/370, 427/393.2; 118/306, 201

[56] References Cited

U.S. PATENT DOCUMENTS 4,182,264 1/1980 Gibson et al. ..... 118/306

FOREIGN PATENT DOCUMENTS 1580192 11/1980 United Kingdom .

*Primary Examiner*—W. Gary Jones

*Assistant Examiner*—Charles K. Friedman

*Attorney, Agent, or Firm*—Leo Fornero

[57] ABSTRACT

An apparatus 5 for applying a creasing setting agent in order to achieve a permanent crease in a textile article such as pants, sheets or the like. The apparatus comprises a support member 12, having a guide member 24 for receiving the textile article to be creased. The support member 12 is mounted on another support or plate 10. There is also included a detachably mounted applicator 31 having a nozzle 34 the applicator being mounted at the one end 50 of the plate member 10 so that the nozzle 34 may be inserted into the opening 32 in the guide member 24. Also a stop member 40 is provided on the guide member 24 and between the opening 32 and the end 50 to substantially preclude hand operation of the applicator as the textile article is being finished.

10 Claims, 1 Drawing Sheet

APPARATUS FOR APPLYING A CREASING AGENT TO A FORMED CREASE IN A TEXTILE ARTICLE

BACKGROUND OF THE INVENTION

The invention contemplated herein relates to an apparatus for applying a crease setting agent to a preformed crease in a textile article such as a pair of pants, a shirt or sheets, pillow cases and pleated items.

The application of such crease setting agents to a formed crease in a pair of pants takes place after the item is manufactured and a crease is pressed on the front and back of each leg. It is customary when applying such agents to reverse the garment or textile article to expose the inside of the preformed crease.

Similarly sheets, pillow cases and shirts could be made up and a crease preformed where desired whereupon the crease setting agent would be applied and then allowed to cure in a position where the crease is maximized or at its optimum. In a pair of pants this is accomplished by laying them out flat or in bundles on what is known in the industry as a pants horse. To form creases in pillow case, sheets and pleated items it is customay to make such items up into panels or portions of the finished item and crease these.

Early techniques at obtaining a crease comprised applying a pressing fluid to the garment before pressing and before it was creased. This concept was shown in French Pat. No. 852,737, corresponding German Pat. No. 683,680 and corresponding British Pat. No. 527,598.

Also *Chemical Week* of Jun. 20, 1973 includes an article titled "Sewing Up A New Market For Glue" wherein there is shown an adhesive hardener which permeates the fabric being joined. A crease like structure results.

A more current attempt to obtain a crease through the application of a crease setting agent is shown in U.S. Pat. No. 4,182,264 relating to an apparatus for forming a permanent crease by introducing an agent into a preformed crease.

U.S. Pat. No. 4,191,793 reexamined and Certificate No. B1 4,191,793 issued also is a similar effort at achieving a durable crease by applying a crease setting agent in a preformed crease.

In both of these U.S. Patents much attention is given to the applicator and providing same with various means for regulating the flow of agent but I have found that there are deficiencies in both these last mentioned systems.

Some of these deficiencies relate to the inefficiencies of the applicator as it takes a substantial time to dispense crease setting agent and it is difficult for the operator of the apparatus to align the temporary crease in the longitudinal slots or channels in the legs or rods fashioned to hold the textile article. If alignment is not accurate the formed crease is unacceptable, and the item is usually discarded as an irregular with a much lower sales price.

British Pat. No. 1,580,192 shows a method of forming a crease in a textile article where a stand includes a surface having a channel or slot adapted to receive the article to be creased. This Patent also has the drawbacks mentioned above.

British Pat. No. 1,472,852 relates to creasing a textile article but the technique is accomplished in a slightly automated fashion.

This last mentioned concept requires the use of an applicator having an indented peripheral surface which carries air back into the dispenser which can cause an air bubble to be deposited on the article thusly resulting in an uneven or unacceptable crease. A doctor member is thusly required and this adds to the complexities of the apparatus.

Finally a deficiency common to many of the above systems is the lack of constant application of the crease setting agent and the inability to control the direction of the agent, in a longitudinal direction as it is being applied to the preformed crease to thereby provide a textile article that is unacceptable. The result is a crooked crease either having too much or too little agent.

In order to overcome this deficiency and other drawbacks in the creasing arrangements known to me I have devised a system which fixes the applicator relative the rod and relative the inverted formed crease to provide an apparatus which would permit an operator to achieve a straight and uniform crease of a predetermined dimension.

This concept was the subject matter in my U.S. patent application Ser. No. 07/188,136 filed Apr. 26, 1988 now abandoned. The problem that resulted from this system was due to the general need to provide an applicator which was detachably mounted on a support and could be detached easily and therefore manipulated manually for touch up purposes.

I have found that with such a system there is a tendency for the operator to at times manually attempt to apply a creasing agent to the crease and you were then presented with the problems of the older type systems outlined hereinabove.

It is therefore an object of this invention to provide an apparatus for creasing textile articles which is efficient, compact and economical to manufacture and lacking in the above mentioned deficiencies and others.

Another object of the present invention is to provide an apparatus for creasing textile articles which permits adjusting width and straightness of the creasing agent to optimize the size of the crease to a highly acceptable degree and in an arrangement which permits both manual manipulation of the applicator and fixing said applicator so as to allow the operator to utilize the most efficient technique.

For a more complete understanding of the invention reference should be made to to the following detailed description of a preferred embodiment and to the accompanying drawings.

BRIEF DESCRIPTION OF THE DRAWINGS

In the drawings wherein like reference characters denote corresponding parts through the several views.

GENERAL DESCRIPTION OF THE INVENTION

Broadly in accordance with the present invention an apparatus designated 5 for applying a crease setting agent to a preformed crease is contemplated whereby a detachable applicator is disposed relative a textile article, usually reversed so that the inside of the crease is exposed, whereby an agent is applied to the crease interior in a steady and straight stream having a predetermined width and depth. This is accomplished by pulling the textile article mounted on the rod by the nozzle of the applicator which is disposed into the preformed crease.

Figure 1:
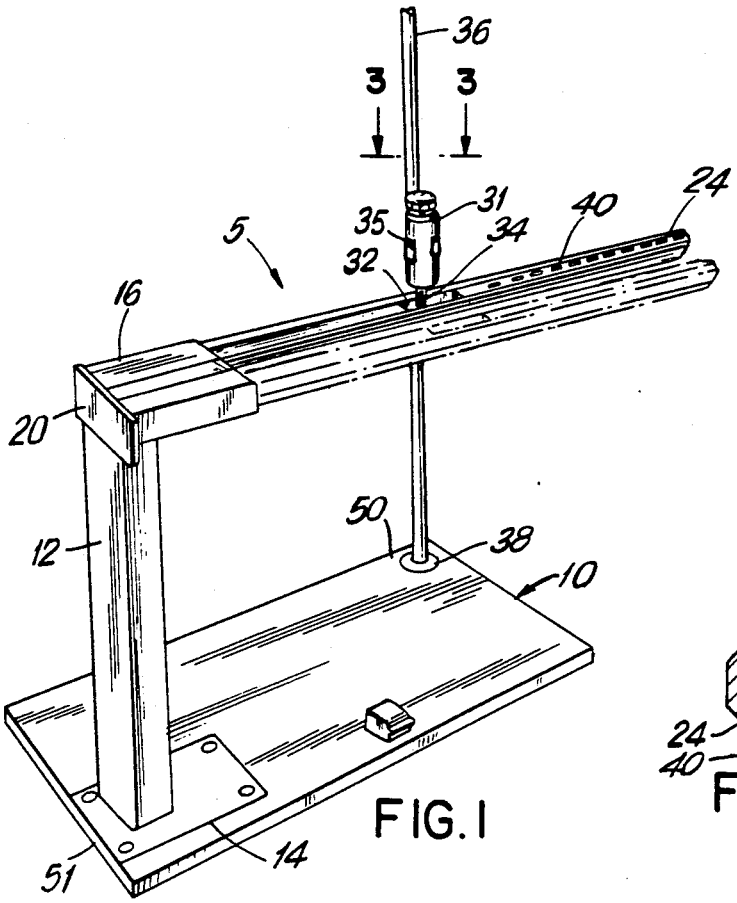
FIG. 1 is a perspective view of the apparatus contemplated herein showing the textile article creaser ready to receive an article for creasing.
Figure 3:
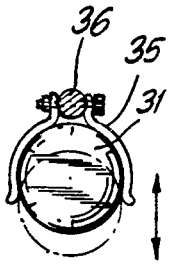
FIG. 3 is a top view looking down lines 3—3 of FIG. 1 showing an approach at detachably fixing the applicator to its support.
Figure 4:
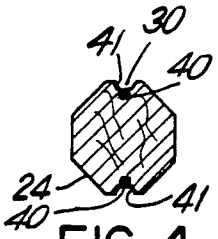
FIG. 4 is a section of the rod taken on lines 4—4 of FIG. 2 showing the slot and detents in the rod.
Figure 5:
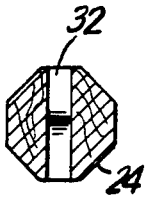
FIG. 5 is a section of the rod taken on lines 5—5 showing the opening to facilitate spreading of the preformed crease.

Such apparatus 5 is shown in FIG. 1 and comprises a support member 10 which comprises a plate heavy enough to hold and stabilize the apparatus mounted thereon. An upstanding support 12 is mounted at its bottom 14 to the support or plate 10 at an end 51. The top portion 16 includes hardware 20 of any well known type such as is shown in U.S. Pat. No. 4,191,793 and such hardware 20 may be fashioned to slide up and down the support 12 and rotate 360 degrees or less by adapting the hardware 12 as desired as is well known in the art.

Attached to the hardware 20 is a rod 24 which usually extends the length of the support 10. The rod 24 is adapted to receive the textile article 25 shown as a leg of a trouser or pant. A crease 30 is preformed in the pant whereupon it is reversed in well known fashion by pants reversers or by hand.

Figure 7:
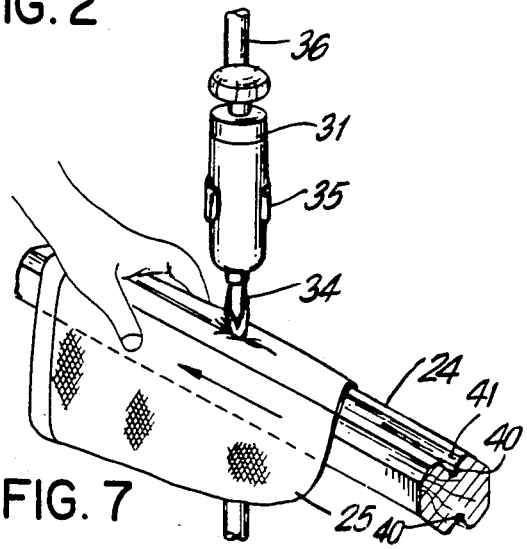
FIG. 7 is a partial perspective view showing the top of a rod with textile article juxtaposed relative the applicator and showing the nozzle in operative position.

The rod includes an opening 32 located so that the nozzle 34 of the applicator 31 as best shown in FIG. 7 will extend into the preformed crease 30 a predetermined amount. By slidably detachably mounting, through spring loaded member or snap 35, the applicator 31, on its support 36 which is disposed vertically relative plate 10 the operator may locate the nozzle 34 into the crease a predetermined distance and then fix same to achieve proper application of crease setting agent. The support 36 is fixed by plate 38 to plate 10 and at end 50 thereof.

As mentioned hereinabove it is beneficial for the operator to be able to detach the applicator to touch up the article but this creates the problem that the operator may attempt to finish the article while the applicator is detached and thereby create an imperfect garment. Detachability may be accomplished as mentioned above through a snap 35 slidably mounted on the support 36. Movement up and down the support 36 may be achieved by a semi-ring type of arrangement not shown or any technique well known in the art. The ring type arrangement may also be provided with a wing nut to tighten same to fix the applicator in any desired position.

Accordingly to preclude substantial manual use from occurring detents or stops 40 are formed in the bottom of the slot 41 which is formed in the rod 24.

Figure 2:
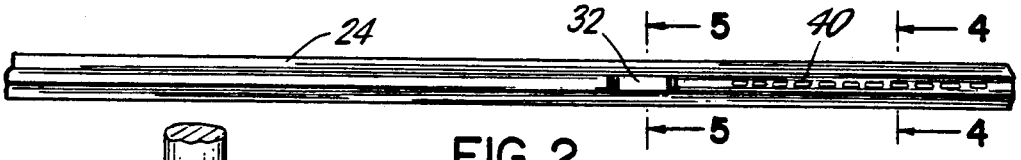
FIG. 2 is a top view of the rod or leg which receives the textile article.
Figure 6:
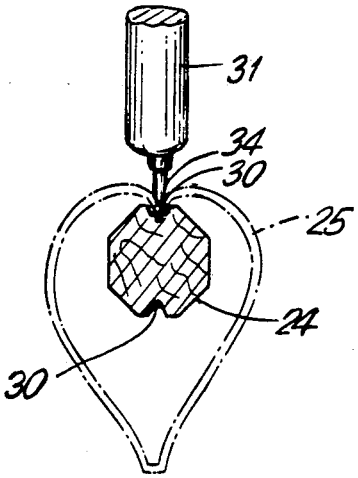
FIG. 6 is a view partially in section showing a textile article in position between the slot and nozzle of the applicator.

These detents shown in FIG. 2 stop use of the applicator beyond the opening 32 to accomplish the desired objective of limiting manual use by the operator. Stated differently, if the operator deems it beneficial to apply a limited amount of creasing agent; this may be accomplished by detaching the applicator 31 and inserting same into the crease 30. The agent is applied by moving the applicator 31 in the crease 30 but the degree of movement of the applicator along the trouser crease is limited by the stops if hand operation continues as the applicator will hit the stops to preclude any extensive hand operation which is undesirable.

I have found in order to achieve a straight and uniform crease of optimum dimension a slot 41 having sides of equal 45 degree slope from a plane passing through the bottom of the slot provides the most desirable crease. It is also beneficial to provide a detent having a depth of a least 1/32 of an inch. The detents are best formed at the bottom of the slot 41 and are spaced equidistantly from each other.

The applicator 31 may be of any well known type as for example that shown in U.S. Pat. No. 4,191,793 reexamined and now including Reexamination Certificate No. B1-4,191,793. Similarly a nozzle 34 is also provided for my arrangement and may be of any shape but it being understood that the size of opening 32 must be taken into consideration when selecting the nozzle 34 as it is beneficial for said nozzle to fit into opening.

OPERATION

In operation the invention contemplated herein operates as follows: a textile article such as the trouser leg shown is creased in any well known fashion as by pressing; the item is then usually reversed and a crease is manually slid onto the leg or rod 24 and the start of the preformed crease is located over the opening 32 whereupon the operator positions applicator nozzle 34 so that it forces the crease slightly into the opening and then sets the applicator in fixed position relative the crease at a position which permits laying an optimum amount of creasing agent into the said crease as the operator draws the article past the nozzle. The textile article is then laid on a horse, not shown, or the like so that the creasing agent may cure.

The same procedure is repeated for the other leg and the item may be folded immediately. Typically one hour or more of time is usually allowed before further use is made of the item.

It will be understood of course that specific forms of the invention herein illustrated and described are intended to be representative only as certain changes may be made in the invention without departing from the clear teachings of the disclosure. Accordingly, reference should be made to the following appended claims determining the full scope of the invention.

What is claimed is:

1. An apparatus for applying a crease setting agent to a preformed crease formed in a textile article such as pants which comprises:

(a) a support member adapted to hold the apparatus;

(b) an upstanding support mounted on said support member and said upstanding support having bottom and top portions;

(c) a guide member extending from the top portion of said upstanding support at one end and having a free end to receive a textile article to be creased;

(d) said guide member being of a predetermined length;

(e) a crease setting applicator including a crease setting agent detachably mounted on said support member;

(f) said guide member having an opening to facilitate the location of said crease setting applicator relative the preformed crease;

(g) said applicator having a nozzle which is selectively fixedly positioned over and into said opening in order to enlarge the crease to facilitate the application of said crease setting agent; and, (h) stop means located on said guide means between said opening and said free end of said guide means to minimize hand operation of said applicator.

2. The apparatus according to claim 1 wherein said stop means comprises a plurality of spaced detents on the top of the guide member when in operating position.

3. The apparatus according to claim 2 wherein said detents are equidistantly spaced from one an other.

4. The apparatus according to claim 3 wherein said guide means includes a slot means having sides which both slope 45 degrees to a plane passing through the bottom of said slope.

5. The apparatus according to claim 2 wherein said guide member includes a slot running between said opening and the free end and said detents are located in said slot and between said opening and said free end.

6. The apparatus according to claim 2 wherein said guide means includes a slot and said detents are centrally located on said slot and on a plane passing vertically through said slot.

7. The apparatus according to claim 1 wherein said guide means includes a slot means having sides which both slope 45 degrees to a plane passing through the bottom of said slot.

8. The apparatus according to claim 7 wherein said stop means are centrally located on said slot means and on a plane passing vertically through said slot means.

9. The apparatus according to claim 8 wherein the slot means includes sides which both slope 45 degrees to a plane passing vertically through said slot means.

10. The apparatus according to claim 9 wherein said stop means are centrally located on said slot means and on a plane passing vertically through said slot means.

* * * * *